US005905420A

United States Patent [19]

Tsujiguchi et al.

[11] Patent Number: 5,905,420

[45] **Date of Patent: *May 18, 1999**

[54] DIELECTRIC FILTER

[75] Inventors: Tatsuya Tsujiguchi; Haruo Matsumoto; Hideyuki Kato, all of Kanazawa, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/783,074

[22] Filed: Jan. 15, 1997

Related U.S. Application Data

[63] Continuation of application No. 08/469,645, Jun. 6, 1995, abandoned.

[30] Foreign Application Priority Data

| | | | |
|---|---|---|---|
| Jun. 16, 1994 | [JP] | Japan | 6-134475 |
| Jun. 28, 1994 | [JP] | Japan | 6-146673 |
| Jul. 14, 1994 | [JP] | Japan | 6-162170 |
| Feb. 20, 1995 | [JP] | Japan | 7-31082 |

[51] Int. Cl.[6] ..... H01P 1/202; H01P 5/12

[52] U.S. Cl. ..... 333/206; 333/134

[58] Field of Search ..... 333/202, 203, 333/206, 207, 222, 223, 202 DB, 126, 129, 134

[56] References Cited

U.S. PATENT DOCUMENTS

| | | | |
|---|---|---|---|
| 4,559,508 | 12/1985 | Nishikawa et al. | 333/202 |
| 4,742,562 | 5/1988 | Kommrusch | 333/202 X |
| 4,890,079 | 12/1989 | Sasaki | 333/202 X |
| 5,010,309 | 4/1991 | Manssen et al. | 333/202 X |
| 5,124,676 | 6/1992 | Ueno | 333/206 |
| 5,130,682 | 7/1992 | Agahi-Kesheh | 333/202 |
| 5,202,654 | 4/1993 | Heine | 333/202 X |
| 5,208,565 | 5/1993 | Sogo et al. | 333/206 |
| 5,216,394 | 6/1993 | Konishi et al. | 333/222 |
| 5,488,335 | 1/1996 | Agahi-Kesheh et al. | 333/207 X |
| 5,537,082 | 7/1996 | Tada et al. | 333/202 |
| 5,546,059 | 8/1996 | Yorita et al. | 333/206 X |
| 5,712,648 | 1/1998 | Tsujiguchi | 333/134 |

FOREIGN PATENT DOCUMENTS

| | | | |
|---|---|---|---|
| 0538894 | 4/1993 | European Pat. Off. . | |
| 165102 | 8/1985 | Japan | 333/202 DB |
| 165103 | 8/1985 | Japan | 333/202 DB |
| 254801 | 12/1985 | Japan | 333/202 DB |
| 19201 | 1/1986 | Japan | 333/202 DB |
| 6303008 | 10/1994 | Japan | 333/206 |

OTHER PUBLICATIONS

Patent Abstract of Japan, vol. 14, No. 560 (E–1012), Dec. 13, 1990 and JP–A–02 241203 (MATSUSHITA ELECTRIC IND. CO. LTD.) Sep. 25, 1990.

Patent Abstract of Japan, vol. 11, No. 227 (E–526), Jul. 23, 1987 and JP–A–62 043904 (MURATA MFG. CO. LTD.) Feb. 25, 1987.

European Search Report dated Oct. 3, 1995.

*Primary Examiner*—Seungsook Ham

*Attorney, Agent, or Firm*—Ostrolenk, Faber, Gerb & Soffen, LLP

[57] ABSTRACT

A dielectric filter is provided which permits one to obtain desired external coupling easily without lowering Qo of resonators. The filter comprises a dielectric block having an open end surface and a shorted end surface and provided with resonator holes. Excitation holes are formed in the block outside the resonator holes, respectively. Input/output electrodes are formed on the open end-surface. The electrodes are electrically connected with conductors formed inside the excitation holes but isolated from an outer conductor. The conductors inside the excitation holes are electrically connected with the outer conductor on the shorted end surface. The excitation holes are electromagnetically coupled to the respective adjacent resonator holes, thus providing external coupling.

28 Claims, 9 Drawing Sheets

Fig. 13
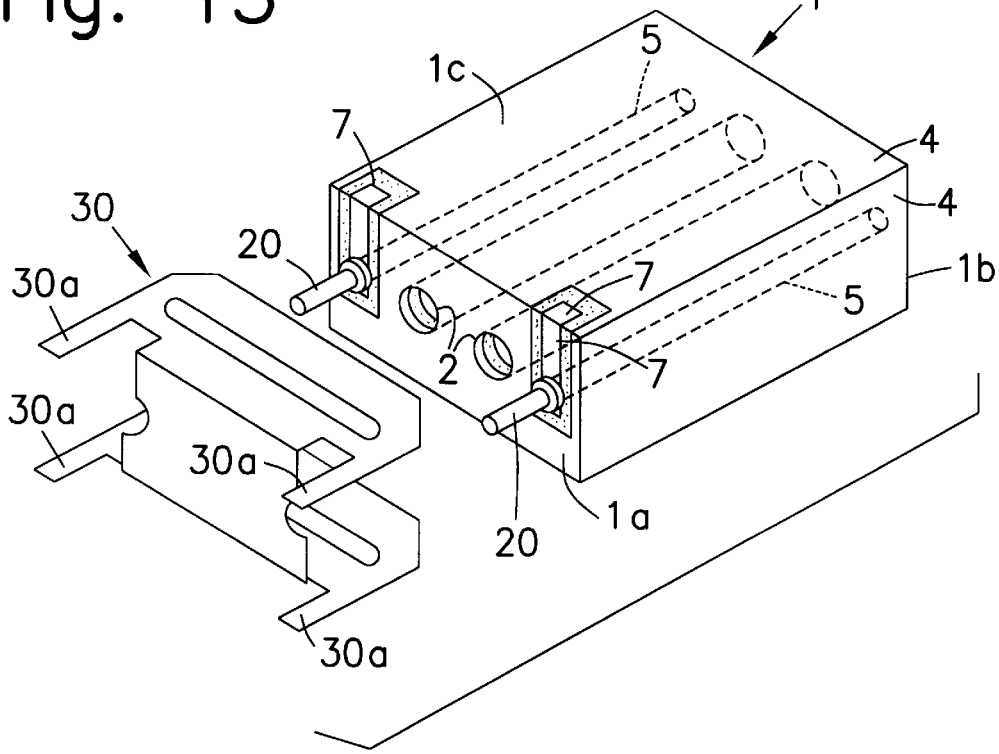
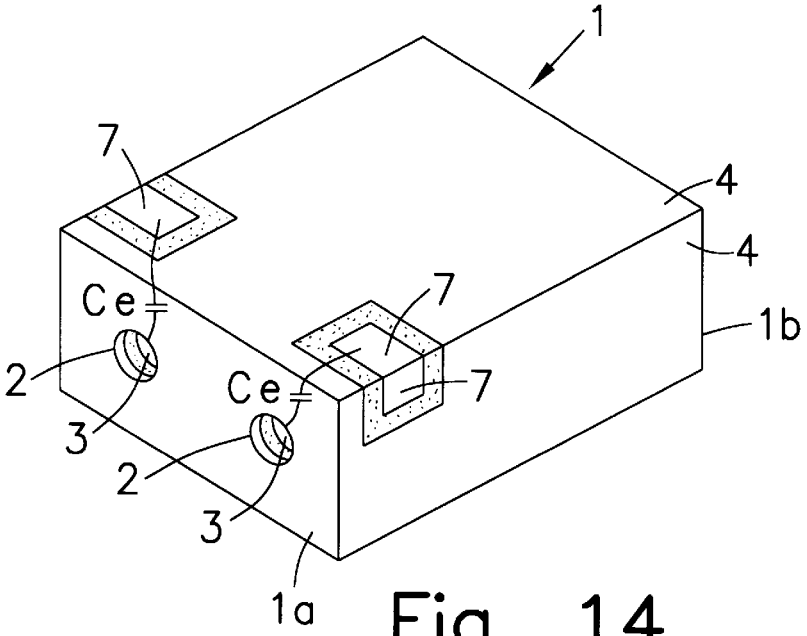
Fig. 14
PRIOR ART

DIELECTRIC FILTER

This is a continuation of application Ser. No. 08/469,645 filed on Jun. 6, 1995, now abandoned.

BACKGROUND OF THE INVENTION

1. Field of the Invention

The present invention relates to a dielectric filter for use in a mobile communication device such as a cellular telephone or other portable telephone.

2. Description of the Related Art

The structure of a prior art dielectric filter comprising a dielectric block is shown in FIG. 14. In the following figures, the shaded portions indicate visible portions of the dielectric material of the dielectric block. On these visible portions, no conductor is formed.

As shown in FIG. 14, this dielectric filter has, for example, two resonator holes 2 extending between a pair of opposite end surfaces of the dielectric filter, indicated by reference numeral 1. Inner conductors 3 are formed on the inner surfaces of the resonator holes 2. An outer conductor 4 is formed on the outer surface of the block 1. A pair of input/output electrodes 7 are formed at desired locations on the outer surface of the dielectric block. No inner conductors 3 are not formed at portions (hereinafter referred to as nonconductive portions) close to one end surface 1*a* (hereinafter referred to as the open end surface) of the openings of the resonator holes 2. These nonconductive portions are isolated from the outer conductor 4. At the opposite surface 1*b* (hereinafter referred to as the shorted end surface), the nonconductive portions are electrically connected or shorted to the outer conductor 4. This dielectric filter consists of two resonators stages each of which is formed in one of the resonator holes 2. These resonators are interconnected in a so-called comb-line connection (coupling) by stray capacitance created in the nonconductive portions.

In this structure, an external coupling capacitance Ce is produced between each input/output electrode 7 and the corresponding inner conductor 3, as shown in FIG. 14. This external coupling capacitance Ce provides external coupling.

When an antenna filter is constructed by using two such dielectric filters, a phase-adjusting circuit is inserted between one end of each filter, and an antenna terminal acting as the common input/output to and from both filters, so that the phase of reflected waves in the passband of one filter will cause the opposite filter to appear as an open circuit. A lumped constant device such as a capacitive device or an inductive device or a distributed constant line such as a cable or stripline is used as the phrase-adjusting circuit.

In the above-described prior art filter which makes use of the external coupling capacitance Ce to obtain external coupling, if a wide passband or strong external coupling is needed, the area of the input/output electrodes may be increased. Alternatively, the resonator holes may be positioned in eccentric positions to shorten the distance between each input/output electrode and the corresponding inner conductor. In this way, adequate external coupling is derived.

However, the foregoing technique requires use of input/output electrodes having a different shape or different dimensions, whenever a desired external coupling is to be obtained. This makes it difficult to standardize the input/output electrodes.

Furthermore, when the area of the input/output electrodes is increased or the resonator holes are positioned in eccentric locations, the unloaded Q (or, Qo) of each resonator drops. In addition, an increase in the area of the input/output electrodes reduces the effective dielectric constant, thus increasing the resonator's electrical length.

Moreover, when an antenna filter or the like is made, using the prior art dielectric filters as described above, phase-adjusting components such as capacitors, coils, or striplines are required in addition to the dielectric filters. Additionally, an operation for mounting and soldering them to a substrate or for forming them on a substrate is required. Consequently, it is difficult to miniaturize the antenna filters. Hence, the cost of the components or fabrication cost is increased.

In particular, in the prior art dielectric filter, once the degree of external coupling at the input and output portions is determined, its phase is also determined. This makes it impossible to set external coupling and phase independently In consequence, it is difficult to obtain a desired external coupling and a desired phase simultaneously. Where a desired phase is associated with a connection to another filter or external circuit, it is necessary to add a separate part for adjusting the phase.

SUMMARY OF THE INVENTION

Accordingly, the present invention is intended to solve the foregoing problems with the prior art techniques. It is an object of the invention to provide a dielectric filter permitting one to obtain appropriate external coupling easily without modifying the shape or dimensions of the input/output electrodes and without decreasing the Qo of the resonators.

It is another object of the invention to provide a dielectric filter which permits one to set the phase at the input and output portions at a desired value without adding phase-adjusting parts, whereby the filter is made up of fewer components and can be made cheaper and smaller than heretofore.

The above objects may be achieved by a first feature of the invention which lies in a dielectric filter comprising a dielectric block having two opposite end surfaces and an outer surface; resonator holes formed in the dielectric block between said end surfaces and acting as input/output stages; inner conductors formed on inner surfaces of the resonator holes, respectively; and an outer conductor formed on the outer surface of the dielectric block. This dielectric filter is characterized in that excitation holes are formed in the block adjacently to the resonator holes and have inner conductors formed inside the excitation holes, and that the excitation holes are electromagnetically coupled to the resonator holes acting as the input/output stages, respectively, thereby providing external coupling.

With the first feature described above, the excitation holes are electromagnetically coupled to their respective resonator holes, whereby the filter provides external coupling. The degree of the external coupling is adjusted or set by varying the diameters or positions of the excitation holes.

A second feature of the invention lies in a dielectric filter comprising a dielectric block having two opposite end surfaces and an outer surface, resonator holes formed in the dielectric block between said end surfaces and acting as input/output stages; inner conductors formed on inner surfaces of the resonator holes, respectively; and an outer conductor formed on the outer surface of the dielectric block. This dielectric filter is characterized in that excitation holes are formed in the block adjacently to the resonator holes acting as the input/output stages and have inner conductors formed inside the excitation holes, and that the positions, shapes, or sizes of the excitation holes have been so set that desired external coupling and phase are obtained.

With the second feature described above, the excitation holes are electromagnetically coupled to their respective resonator holes, whereby the filter provides external coupling. Desired external coupling and phase can be established by varying the positions, the shapes, or the sizes of the excitation holes.

A third feature of the invention lies in a dielectric filter comprising: a dielectric block having two opposite end surfaces and an outer surface; resonator holes formed in the dielectric block between said end surfaces; inner conductors formed on inner surfaces of the resonator holes, respectively; and an outer conductor formed on the outer surface of the dielectric block. This dielectric filter is characterized in that excitation holes are formed in the block adjacently to the resonator holes and have inner conductors formed inside the excitation holes, and that external coupling-adjusting holes are formed in the block close to the excitation holes, respectively, acting as input/output stages and have inner conductors formed on inner surfaces of the external coupling-adjusting holes, respectively.

With the third feature described above, desired external coupling is provided by varying the positions, the shapes, or the sizes of the external coupling-adjusting holes. That is, the external coupling can be established with a greater degree of freedom because the external coupling-adjusting holes are provided. Where resonator holes are formed on opposite sides of each excitation hole, the coupling between two resonator holes on opposite sides of at least one excitation hole can be suppressed.

A fourth feature of the invention is based on any one of the first through third features described above and characterized in that input/output electrodes are formed on one end surface of the dielectric block or extend from this end surface to one side surface of the dielectric block, are electrically connected with the inner conductors: formed inside the-excitation holes, and are not connected to the outer conductor.

The fourth feature described above yields the above-described advantages. In addition, the filter can be connected with an external circuit, or a packaging substrate, through the input/output electrodes electrically connected with the conductors formed inside the excitation holes. These input/output electrodes are not intended to provide external coupling. Rather, the shapes and the dimensions of these electrodes can be set at will. That is, the shapes and the dimensions can be set in such a way that the characteristics such as Qo are not deteriorated. When the input/output electrodes are designed to extend from one end surface to one side surface, the end surface and/or the side surface can be used as a mounting surface. That is, the dielectric filter can be placed either horizontally or vertically.

A fifth feature of the invention is based on any one of the first through third features described above and characterized in that the dielectric block has regions in which said excitation holes are formed, and that the regions have been partially removed so that one end surface of the dielectric block has steps.

A sixth feature of the invention is based on any one of the first through third features described above and characterized in that the inner conductors formed inside the excitation holes or the inner conductors formed inside the external coupling-adjusting holes have been partially removed to adjust external coupling and phase. Thus, the external coupling and phase can be adjusted.

With the fifth feature described above, the dielectric block has been partially removed, so that the length of the excitation holes is adjusted. The degree of external coupling can be varied by varying the length of the excitation holes, as well as the diameter or the positions of the excitation holes. Therefore, the external coupling can be adjusted or established with a greater degree of freedom Hence, more appropriate external coupling can be obtained.

A seventh feature of the invention is based on any one of the first through third features described above and characterized in that there are further provided input/output terminals which are inserted in the excitation holes and electrically connected with the inner conductors formed inside the excitation holes.

With the seventh feature described above, the filter can be connected with an external circuit, or a packaging substrate, via the input/output terminals electrically connected with the conductors formed inside the excitation holes. That is, the filter can be mounted on a terminal insertion type packaging substrate. The dielectric filter can be placed either horizontally or vertically by bending the input/output terminals. Furthermore, the location at which the connection with the packaging substrate is made can be set at will by varying the length of the input/output terminals. In this case, it is not necessary to form the input/output electrodes. Qo can be improved further.

An eighth feature of the invention is based on any one of the first through third features described above and characterized in that there is further provided a metallic casing mounted on the dielectric block so as to cover at least a part of the block.

With the eighth feature described above, leakage of electro-magnetic field from the openings of the resonator holes can be reduced by the presence of the metallic casing.

Other objects and features of the invention will appear in the course of the description of embodiments thereof, which follows .

BRIEF DESCRIPTION OF THE DRAWINGS

FIG. 9(*b*) is a plan view of the shorted end surface of the dielectric filter (antenna duplexer) shown in FIG. 9(*a*);

FIG. 13 is a perspective view of a dielectric filter according to a seventh example of the invention; and FIG. 14 is a perspective view of a prior art dielectric filter.

DETAILED DESCRIPTION OF PREFERRED EMBODIMENTS

Figure 1:
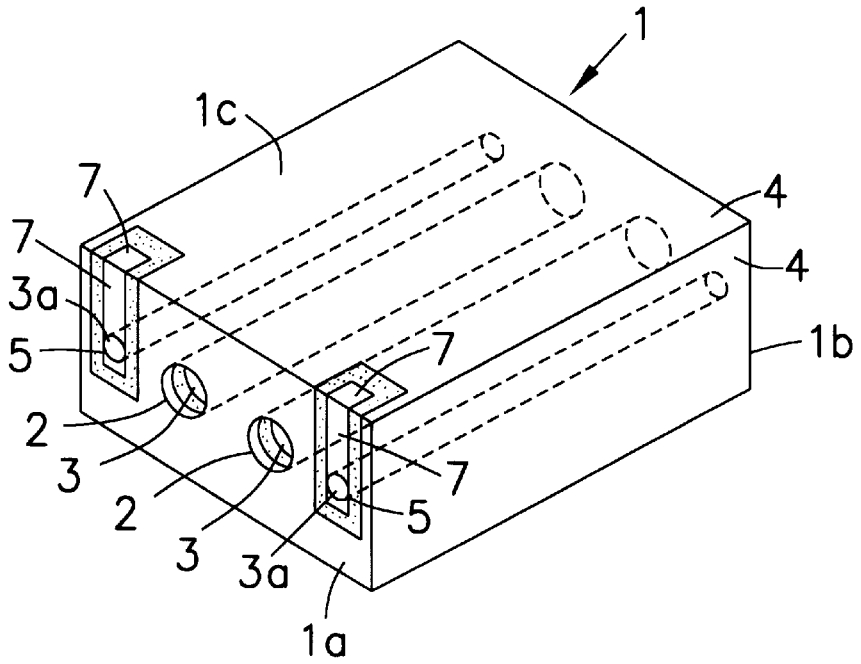
FIG. 1 is a perspective view of a dielectric filter according to a first example of the invention.

Several preferred embodiments of the invention are hereinafter described with reference to the accompanying drawings, in which like components are indicated by like reference numerals. The structure of a dielectric filter that is a first example of the present invention is shown in FIG. 1.

As shown in FIG. 1, this dielectric filter comprises a dielectric block 1 taking the form of a substantially rectangular parallelepiped. Two resonator holes 2 and a pair of excitation holes 5 are formed in the block 1. The resonator holes 2 extend between two opposite end surfaces of the block. Inner conductors 3 are formed on the inner surfaces of the resonator holes 2, respectively. An outer conductor 4 is formed substantially over the whole surface of the dielectric block 1. The excitation holes 5 are formed outside the resonator holes 2, respectively. A pair of input/output electrodes 7 extend from the open end surface 1*a* to one side surface 1*c* (the top surface in the figure). The electrodes 7 are electrically connected with inner conductors 3*a* in the excitation holes 5 but disconnected from the outer conductor 4, That is, the inner conductors 3*a* in the excitation holes 5 are disconnected from the outer conductor 4 at the open end surface 1*a* and electrically connected with the outer conductor 4 at the shorted end surface 1*b*.

Nonconductive portions are formed in the inner conductors 3 inside the resonator holes 2 near the open end surface 1*a*. At the shorted end surface 1*b*, the inner conductor 3 are electrically connected or shorted to the outer conductor 4. Resonators formed by the resonator holes 2, respectively, are connected to each other in so-called comb-line connection by stray capacitance created in the nonconductive portions.

In this structure, the excitation holes 5 and their respective adjacent resonator holes 2 are electromagnetically coupled together. This electromagnetic coupling provides external coupling of the input/output portions of the dielectric filter. The input/output electrodes 7 are formed simply to make a connection with an external circuit.

The degree of the external coupling can be adjusted or established by varying the distance between the conductor 3*a* inside each excitation hole 5 and the conductor 3 inside the adjacent resonator hole 2, which is accomplished by varying the inside diameter or the position of the excitation hole 5. That is, if the inside diameter of each excitation hole 5 is increased, or if it is brought closer to the resonator hole 2, then the distance between the adjacent inner conductors is reduced. This provides stronger external coupling.

In this structure, the external coupling is determined neither by the shape nor by the dimensions of the input/output electrodes 7. Therefore, the strength of the external coupling can be changed independently of the shape and the dimensions of the input/output electrodes 7. Hence, the input/output electrodes 7 can be standardized. This permits standardization of patterns on packaging substrates. As a results costs of mounting can be curtailed.

Furthermore, the area of the input/output electrodes can be reduced and so the drop in Qo which would normally be caused by large input/output electrodes does not take place. Additionally, an increase in resonator electrical length which would normally be caused by a decrease in effective dielectric constant is prevented. Moreover, it is not necessary to place the resonator holes 2 in greatly eccentrically shifted positions. Consequently, the drop of Qo which would normally be caused by eccentric positioning of the resonator holes 2 can be suppressed. Hence, a small-sized dielectric filter which has high Qo, produces only a small amount of insertion loss, and provides desired external coupling can be obtained.

Since the input/output electrodes 7 are so formed as to extend from the open end surface 1*a* to one side surface 1*c*, either the open end surface 1*a* or the side surface 1*c* can be mounted on a packaging substrate. That is, the dielectric filter of the present example can be placed either horizontally or vertically on the packaging substrate.

Figure 2:
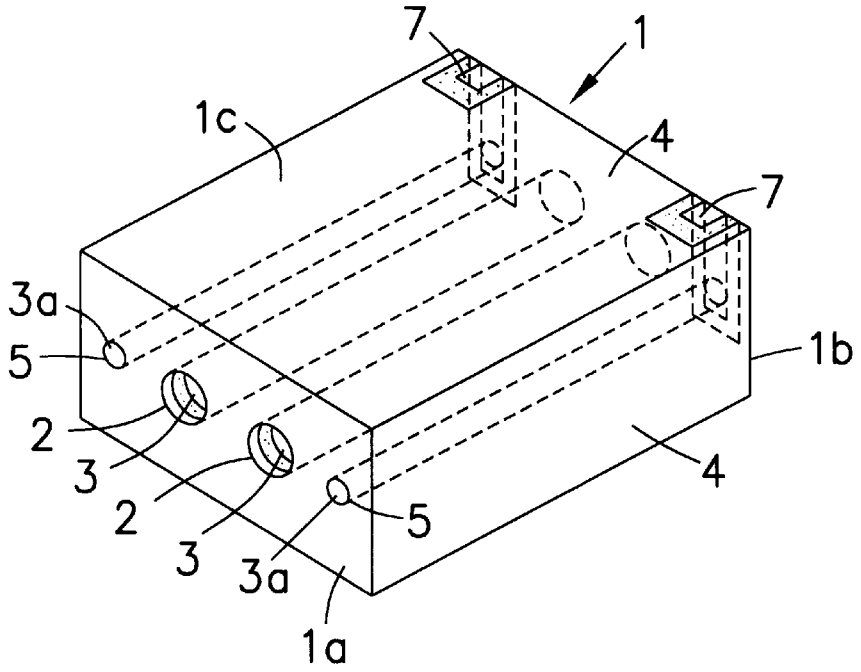
FIG. 2 is a perspective view of a dielectric filter according to a second example of the invention.

The structure of a dielectric filter according to a second example of the invention is shown in FIG. 2. As shown in FIG. 2, this dielectric filter is similar to the dielectric filter already described in connection with FIG. 1 except that a pair of input/output electrodes 7 extend from the shorted end surface 1*b* to one side surface 1*c* (the top surface in the figure) and are electrically connected with the inner conductors 3*a* in the excitation holes 5, respectively, but are not connected to the outer conductor 4. That is, the conductors 3*a* inside the excitation holes 5 are electrically connected with the outer conductor 4 at the open end surface 1*a* but isolated from the outer conductor 4 at the shorted end surface 1*b*. In this dielectric filter, the input/output electrodes 7 are formed on the side of the shorted end surface 1*b* in an opposite relation to the structure of the first example previously described in conjunction with FIG. 1.

In this structure, the shorted end surface 1*b* is affected to a greater extent by a magnetic field than the open end surface 1*a*. Therefore, this second example can provide stronger external coupling, or stronger electromagnetic coupling, than the first example. Also in this example, the degree of external coupling can be adjusted or set by varying the diameter or positions of the excitation holes 5 without changing the positions or dimensions of the input/output electrodes or the positions of the resonator holes 2. This makes it easy to standardize the input/output electrodes 7. Also, the Qo is prevented from dropping.

In the above-described examples, the inner conductors 3*a* in the excitation holes 5 are electrically connected with the outer conductor 4 at one end of each excitation hole 5. This structure can provide stronger external coupling, or stronger electromagnetic coupling, wherein a structure that the excitation holes 5 not electrically connected to the outer conductor 4.

Figure 3:
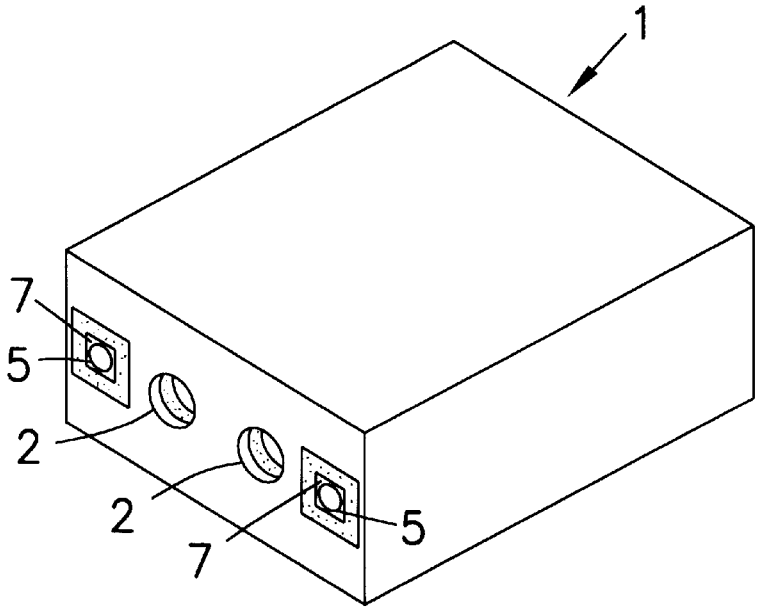
FIG. 3 is a perspective view of a modified dielectric filter according to the first example.
Figure 4:
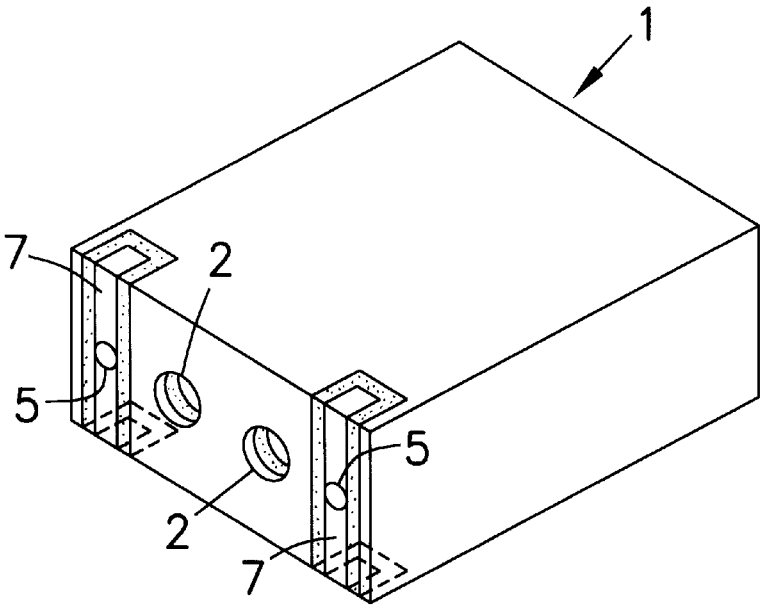
FIG. 4 is a perspective view of a further modified dielectric filter according to the first example.
Figure 5:
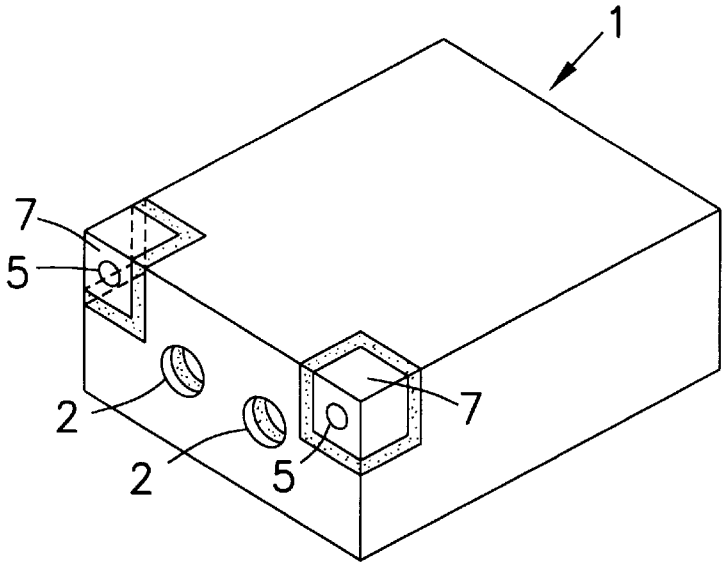
FIG. 5 is a perspective view of yet another modified dielectric filter according to the first example.

In the above-described examples, the input/output electrodes 7 extend from one end surface of the dielectric block 1 to an adjacent side surface. The invention is not limited to this structure. As shown in FIG. 3, the electrodes 7 may be formed only on one end surface. As shown in FIG. 4, the electrodes may extend from the top side surface to the bottom side surface across one end surface. As shown in FIG. 5, each electrode 7 may extend from one end surface to two adjacent side surfaces which are perpendicular to each other. In the dielectric filter shown in FIG. 4, any one of the three surfaces on which the input/output electrodes 7 are formed may be used as a mounting surface and attached to a mounting substrate.

In the examples in FIGS. 1–4 described above, the excitation holes 5 are formed substantially along the center plane passing through the center of the dielectric block 1 in the direction of the thickness. As shown in FIG. 5, the excitation holes 5 may be shifted from the center plane toward the top or bottom side of the dielectric block 1. No restrictions are imposed on the vertical positions of the excitation holes 5 in the dielectric block 1.

Figure 6:
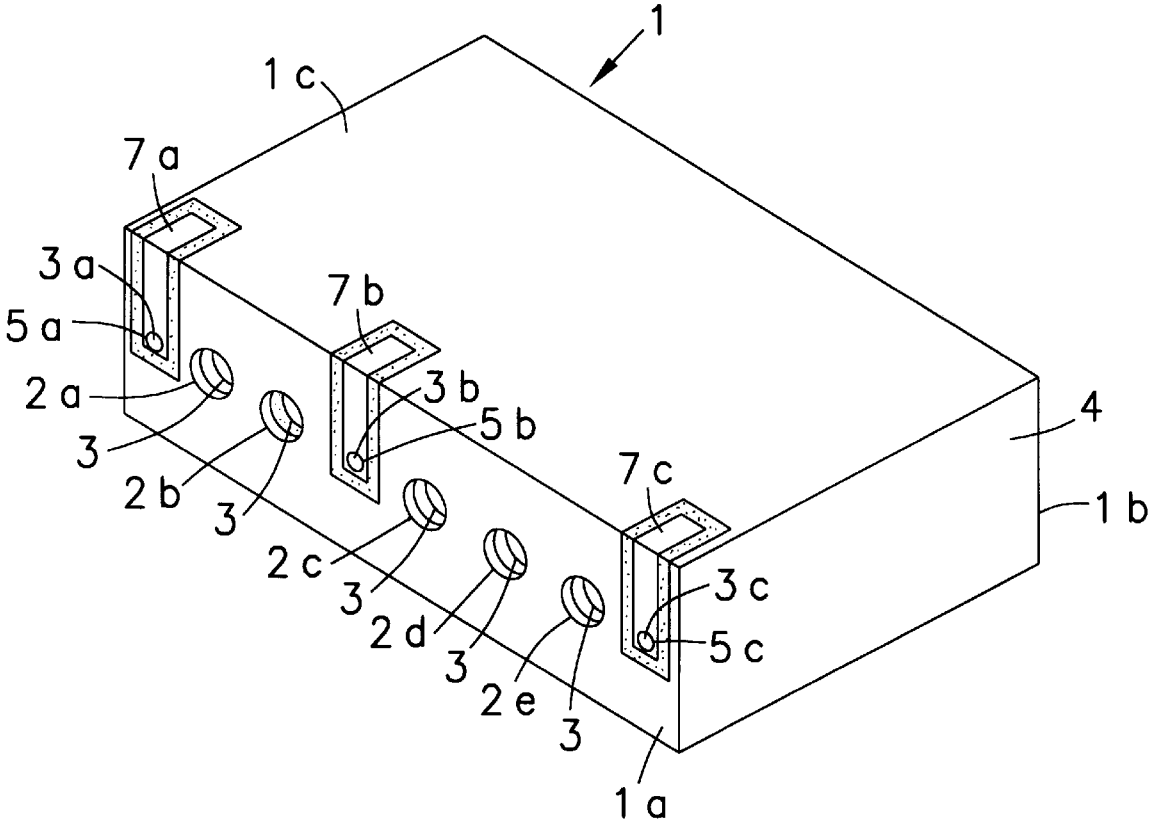
FIG. 6 is a perspective view of a dielectric filter (antenna duplexer) according to a third example of the invention.
Figure 7A:
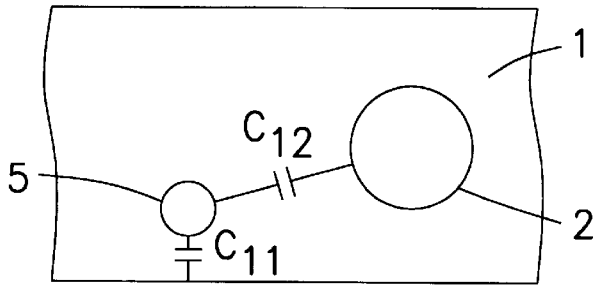
FIGS. 7(*a*)–7(*d*) are schematic cross sections showing respective variations of dielectric filters according to the inventions taken close to excitation holes.
Figure 7B:
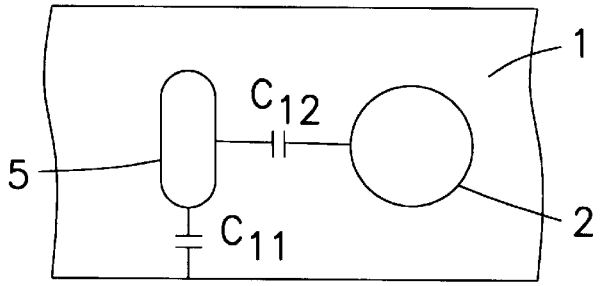
Figure 7C:
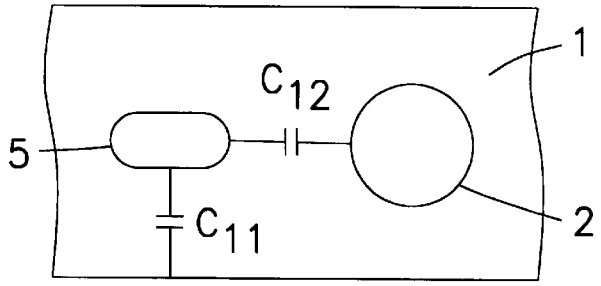
Figure 7D:
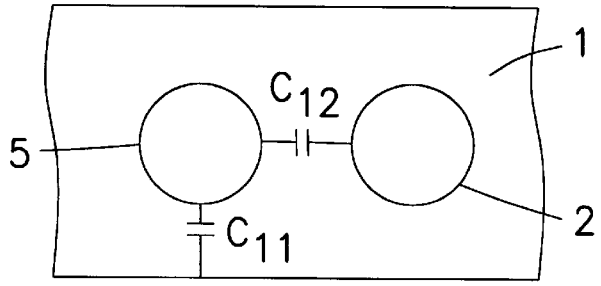

The structure of a dielectric filter (antenna duplexer) according to a third example of the invention is shown in FIG. 6. As shown in FIG. 6, five resonator holes 2*a*, 2*b*, 2*c*, 2*d*, and 2*e* extend between a pair of end surfaces of a dielectric block 1 An excitation hole 5*a* is located toward the outside the resonator hole 2*a*. Another excitation hole 5*b* is formed between the resonator holes 2*b* and 2*c*. A further excitation hole 5*c* is located toward the outside from the resonator hole 2*e*. Inner conductors 3 are formed on the inner surfaces of the resonator holes 2*a*–2*e* and inner conductors 3*a*–3*c* are formed on the inner surfaces of the excitation holes 5*a*, 5*b*, and 5*c*, respectively An outer conductor 4 is formed substantially over the whole outer surface of the dielectric block 1. Three input/output electrodes 7*a*, 7*b*, and 7*c* extend from the open end surface 1*a* to one side surface 1*c* and are electrically connected with the inner conductors 3 in the excitation holes 5*a*–5*c* but not connected to the outer conductor 4.

The inner conductors 3*a*, 3*b* and 3*c* in the recitation holes 5*a*, 5*b*, and 5*c* are electrically connected with the outer conductor 4 at the shorted end surface 1*b*. The inner conductors 3 in the resonator holes 2*a*–2*e* are disconnected from the outer conductor 4 by nonconductive portions at the open end surface 1*a*. The inner conductors 3 are electrically connected with the outer conductor 4 at the shorted end surface 1*b*.

In this structure, two resonators formed by the resonator holes 2*a* and 2*b* cooperate to form a transmission filter or reception filter. Three resonators formed by the resonator holes 2*c*, 2*d*, and 2*e* constitute a reception filter or transmission filter.

The excitation holes 5*a* and 5*c* are electromagnetically coupled to the resonator holes 2*a* and 2*e*, respectively. The excitation hole 5*b* is electromagnetically coupled to the adjacent resonators 2*b* and 2*c*. These electromagnetic couplings provide external coupling. The input/output electrodes 7*a*, 7*b*, and 7*c* are formed simply for external connection with an external circuit. The input/output electrode 7*b* between the resonator holes 2*b* and 2*c* is an antenna electrode shared by the inputs and outputs of the transmission and reception filters.

Also in this example, external coupling is provided by electromagnetic coupling between each excitation hole 5*a*, 5*b*, or 5*c* and the adjacent resonator hole 2*a*, 2*b*, 2*c*, or 2*e*. Therefore, the degree of external coupling can be adjusted or set by varying the diameters or positions of the excitation holes 5*a*, 5*b*, and 5*c* without changing the positions or dimensions of the input/output electrodes 7 or the positions of the resonator holes 2*a*–2*e*. Consequently, the input/output electrodes 7 can be standardized with ease. Also, Qo is prevented from decreasing.

Moreover, in dielectric filters of the above-described various examples, the phase as well as external coupling can be set, by varying the positions, the shape, or the inside diameter of the excitation holes. That is, the phase can be varied while maintaining the external coupling constant.

Experiments were conducted on the relations among the positions of the excitation holes, the shape, the external coupling, and the phase. The experiments and results are now described. FIGS. 7(*a*)–7(*d*) are schematic cross sections of dielectric filters, taken close to the location of one excitation hole. These figures illustrate a method of establishing the self-capacitance C11 of the excitation hole 5 formed between the conductor inside the excitation hole 5 and the outer conductor and the mutual capacitance C12 created between the excitation hole 5 and the conductor inside the resonator hole 2.

In FIG. 7(*a*), the excitation hole 5 is shifted toward either the upper or lower side of the dielectric block. In this illustrated example, the hole is shifted toward the lower side, to increase the self-capacitance C11 and to reduce the mutual capacitance C12. In FIGS. 7(*b*) and 7(*c*), the excitation hole 5 assumes substantially an elliptical shape. The self-capacitance C11 and the mutual capacitance C12 can be set to various values by varying the longitudinal direction of the excitation hole 5. In FIG. 7(*d*), the inside diameter of the excitation hole 5 is increased to increase both self-capacitance C11 and mutual capacitance C12. In this way, the self-capacitance C11 and mutual capacitance C12 can be changed by varying the position, shape, or size of the excitation hole.

Figure 8:
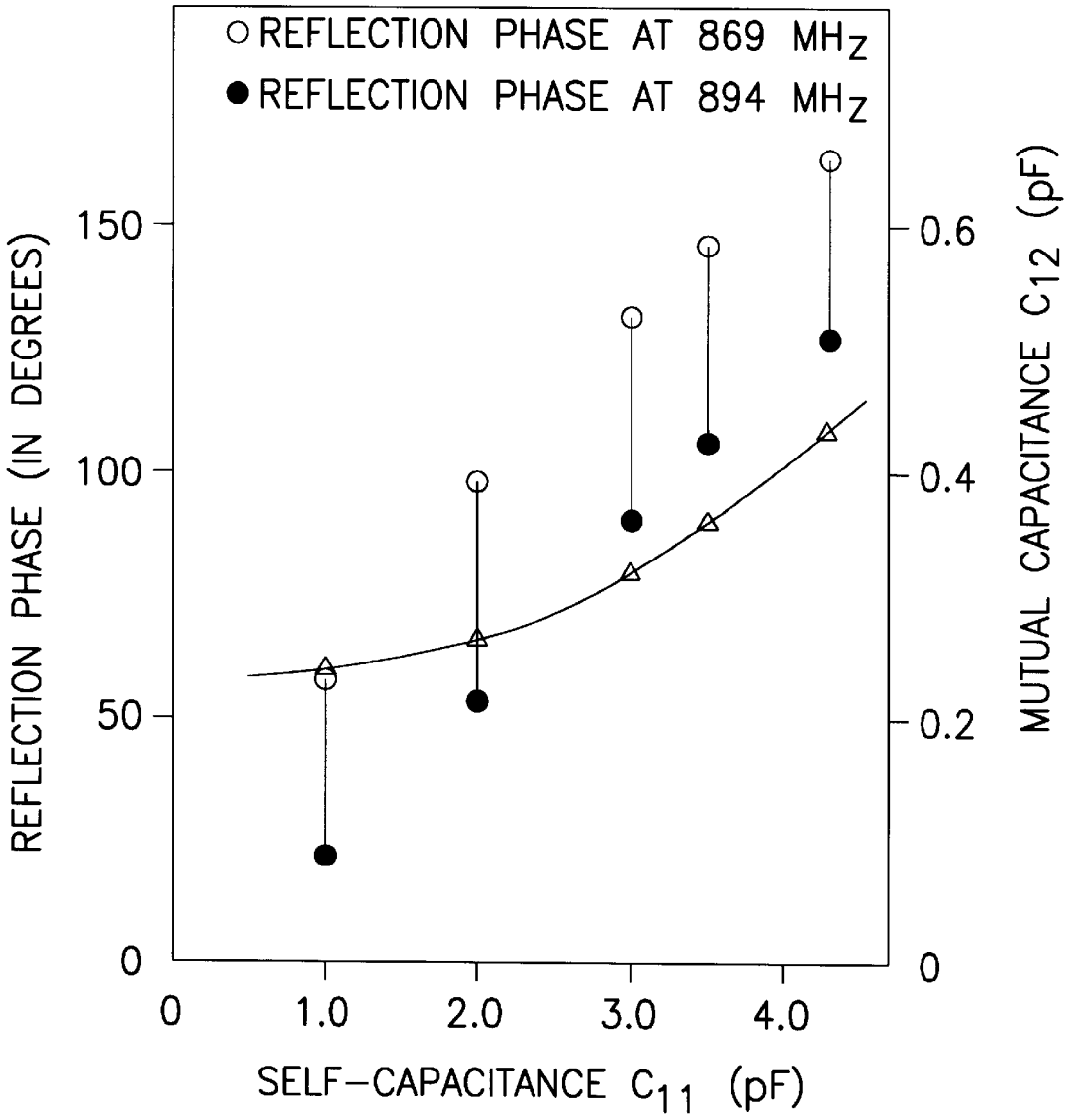
FIG. 8 is a graph showing the relation between self-capacitance and mutual capacitance of excitation holes in a dielectric filter according to the second example of the inventions as well as the relation between self-capacitance and reflection phase.

The relations of these capacitances C11 and C12 to the external coupling and to the phase of the dielectric filter according to the second example are shown in FIG. 8. FIG. 8 shows results of measured reflection phases about this filter having a center frequency of 836.5 MHz in the passband of the opposite filter, the passband lying in the frequency range of 869 to 894 MHz. In FIG. 8, the relation between the self-capacitance C11 of the excitation hole and the mutual capacitance C12 obtained where the external coupling is constant is indicated by triangles. Under this condition, the relation between the self-capacitance $C_{11}$ and the reflection phase at 869 MHz is indicated by white circles. The relation between the self-capacitance $C_{11}$ and the reflection phase at 894 MHz is indicated by black circles.

As shown in FIG. 8, the external coupling can be maintained constant by varying the position, the shape, or other factor of the excitation hole so as to vary the self-capacitance C11 and the mutual capacitance C12. That is, the reflection phase can be reduced while maintaining the external coupling constant, by reducing both self-capacitance C11 and mutual capacitance C12. In other words, the reflection phase can be made to approach the open state.

Therefore, where an antenna filter is built using such dielectric filters, if the positions, the shapes, or the sizes of the excitation holes in one filter corresponding to an antenna end are varied, then the reflection phase in the passband of the opposite filter can be made to assume an open state. Consequently, an antenna filter can be easily built without adding separate phase-adjusting components such as capacitive devices, inductive devices, or striplines. In particular, an antenna filter can be constructed simply by using two such dielectric filters or by using one such dielectric filter together with the prior art dielectric filter shown in FIG. 14 and then directly interconnecting respective input or output electrodes of the two filters.

It is to be understood that application of the invention is not limited to antenna filters. Where a connection with an external circuit is made and it is necessary to vary the phase at the input/output portion, appropriate matching to the external circuit can be obtained similarly without adding separate phase-adjusting components.

Each excitation hole can be shaped into any desired form. For example, the cross-sectional shape of the hole can be an ellipse, rectangle, triangle, or any other form. In the above examples, the dielectric filter is composed of two stages of resonators. The filter may also consist of only one stage of resonator. Furthermore, the filter may be made up of three or more stages of resonators.

Figure 9A:
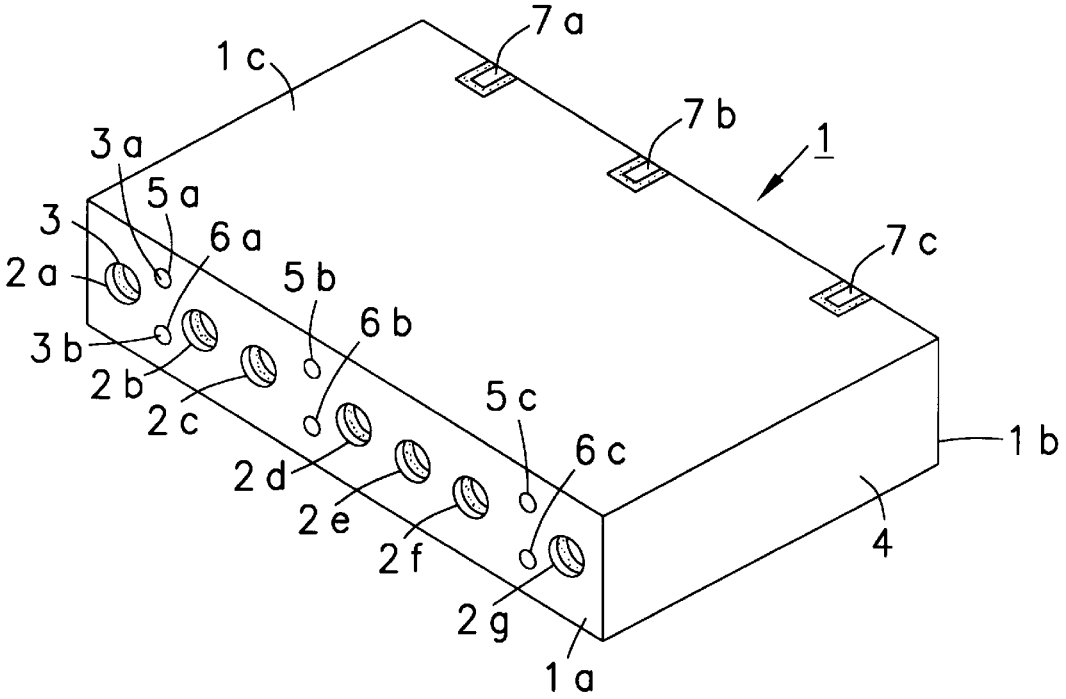
FIG. 9(*a*) is a perspective view of a dielectric filter (antenna duplexer) according to a fourth example of the invention.
Figure 9B:
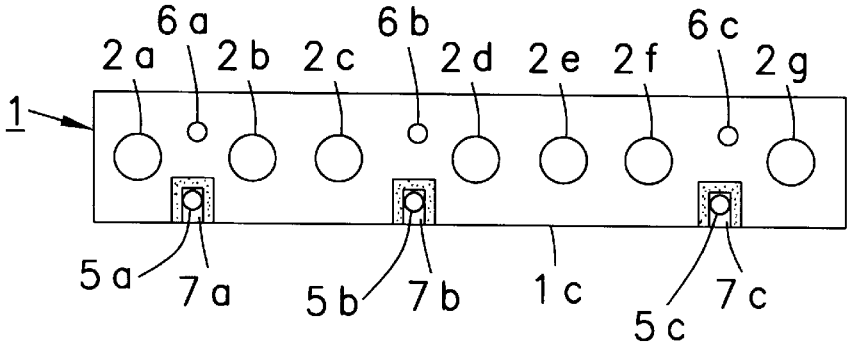

The structure of a dielectric filter (antenna duplexer) according to a fourth example of the invention is shown in FIGS. 9(*a*) and 9(*b*). FIG. 9(*a*) is a perspective view of the dielectric filter (antenna duplexer) as viewed from the side of the open end surface. The bottom surface 1*c* forming a mounting surface is shown to be located at the top. FIG. 9(*b*) is a plan view of the shorted end surface. The bottom surface 1*c* forming a mounting surface is shown to be located at the bottom.

As shown in FIGS. 9(*a*) and 9(*b*), the dielectric filter (antenna duplexer) of the present example comprises a dielectric block 1 substantially in the form of a rectangular parallelepiped. This block has a pair of opposite end surfaces 1*a* and 1*b* (See FIG. 9*a*). Seven resonator holes 2*a*, 2*b*, 2*c*, 2*d*, 2*e*, 2*f*, 2*g* extend between these end surfaces 1*a* and 1*b*. An excitation hole 5*a* and an external coupling-adjusting hole 6*a* are formed between the resonator holes 2*a* and 2*b*. An excitation hole 5*b* and an external coupling-adjusting hole 6*b* are formed between the resonator holes 2*c* and 2*d*. An excitation hole 5*c* and an external coupling-adjusting hole 6*c* are formed between the resonator holes 2*f* and 2*g*. Conductors 3 are formed on the inner surfaces of the resonator holes 2*a*–2*g*, conductors 3*a* are formed on the inner surfaces of the excitation holes 5*a*, and conductors 3*b* are formed on the inner surfaces of the external coupling-adjusting holes 6*a*–6*c*. An outer conductor 4 is formed substantially over the whole outer surface of the dielectric block 1.

Three input/output electrodes 7*a*, 7*b*, and 7*c* extend from the shorted end surface 1*b* to one side surface, or the bottom surface. The input/output electrodes 7*a*, 7*b*, and 7*c* are electrically connected with the conductors 3*a* (See FIG. 9*a*) inside the excitation holes 5*a*–5*c* but isolated from the outer conductor 4. That is, the conductors 3*a* inside the excitation holes 5*a*–5*c* are electrically connected with the outer conductor 4 at the open end surface 1*a* and disconnected from the outer conductor 4 (See FIG. 9*a*) at the shorted end surface 1*b*. The conductors 3 (See FIG. 9*a*) inside the resonator holes 2*a*–2*e* are isolated from the outer conductor 4 by nonconductive portions formed in the inner conductors close to the open end surface 1*a* and are electrically connected with the outer conductor 4 at the shorted end surface 1*b*.

The external coupling-adjusting holes 6*a*, 6*b*, and 6*c* are formed close to the excitation holes 5*a*, 5*b*, and 5*c*, respectively. The array of the adjusting holes 6*a*–6*c* is parallel to the array of the excitation holes 5*a*–5*c*. The conductors 3*b* (See FIG. 9*a*) formed inside the external coupling-adjusting holes 6*a*, 6*b*, and 6*c* are electrically connected with the outer conductor 4 at the open end surface 1*a*, as well as at the shorted end surface 1*b*. That is, the conductors 3*b* inside the adjusting holes 6*a*–6*c* act as grounding conductors similarly to the outer conductor 4.

In this structure, the excitation hole 5*a* is electromagnetically coupled to the adjacent resonator holes 2*a* and 2*b*. The excitation hole 5*b* is electromagnetically coupled to the adjacent resonator holes 2*c* and 2*d*. The excitation hole 5*c* is electromagnetically coupled to the adjacent resonator holes 2*f* and 2*g*. External coupling is provided by these electromagnetic couplings. The filter is connected with an external circuit via the input/output electrodes 7*a*, 7*b*, and 7*c* which are electrically connected with the conductors 3*a* inside the excitation holes 5*a*–5*c*. The input/output electrode 7*b* is an antenna electrode acting as one input/output of a transmission filter and also as one input/output of a reception filter.

In the antenna filter of the present example, the self-capacitance of each excitation hole can be increased and reduced by varying the location, shape, or inside diameter of the external coupling-adjusting hole formed close to the excitation hole. Therefore, the external coupling can be modified, and external coupling can be established more appropriately That is, the external coupling can be established with a greater degree of freedom by adding the external coupling-adjusting holes.

The self-capacitance of each excitation hole is the capacitance created between the conductor inside the excitation hole and the grounding conductor, or the outer conductor plus the conductor inside the external coupling-adjusting hole. The self-capacitance of each excitation hole can be increased by providing the external coupling-adjusting hole. By reducing the distance between the excitation hole and the external coupling-adjusting hole, the self-capacitance of the excitation hole can be increased, and the external coupling can be weakened. Conversely, by increasing the distance between the excitation hole and the external coupling-adjusting hole, the self-capacitance of the excitation hole can be reduced and the external coupling can be intensified.

Since the external coupling can be weakened by providing the external coupling-adjusting holes in this way, the distance between each excitation hole and the adjacent resonator hole can be reduced. Hence, the size of the filter can be reduced. That is, in the present example, the distance between the resonator holes 2*a* and 2*b*, the distance between the resonator holes 2*c* and 2*d*, and the distance between the resonator holes 2*f* and 2*g* can be reduced.

Furthermore, the coupling between two resonator holes between which one excitation hole and one external coupling-adjusting hole are located can be suppressed by the external coupling-adjusting hole. In the present example, direct coupling between the resonator holes 2*a* and 2*b*, direct coupling between the resonator holes 2*c* and 2*d*, and direct coupling between the resonator holes 2*f* and 2*g* can be suppressed by the external coupling-adjusting holes 6*a*, 6*b*, and 6*c*, respectively. Specifically, direct coupling of the trap formed by the resonator hole 2*a* can be reduced greatly. Also, direct coupling of the filter formed by the resonator holes 2*b*, 2*c*, the filter formed by the resonator holes 2*d*, 2*e*, 2*f*, and the trap formed by the resonator hole 2*g* can be reduced greatly. In consequence, the characteristics of the filters and traps can be adjusted readily. As a result, good characteristics can be obtained.

Once a filter is constructed, the self-capacitance or other factor of each excitation hole can be varied by grinding parts of the conductors either in the excitation holes or in the external coupling-adjusting holes with a grinding tool or grindstone. In this manner, the external coupling and phase can be adjusted. Therefore, the characteristics can be improved. Also, the percentage of defective products can be reduced. In this case, the dielectric substance can be ground together with the inner conductors.

In the above examples, one external coupling-adjusting hole is formed corresponding to each one excitation hole. The present invention is not limited to this structure. A plurality of external coupling-adjusting holes may be formed corresponding to each one excitation hole. The external coupling-adjusting holes may be shaped into any arbitrary form, which can be an ellipse, rectangle, triangle, or rhomboid.

In the above examples, two filters and two traps are formed in one dielectric block. In this way, the dielectric filter or antenna resonator has a complicated structure. It is to be noted that the present invention is not restricted to this structure. The present invention is also applicable to a dielectric filter comprising a dielectric block 1 in which one filter is formed, as shown in FIG. 10.

Figure 10:
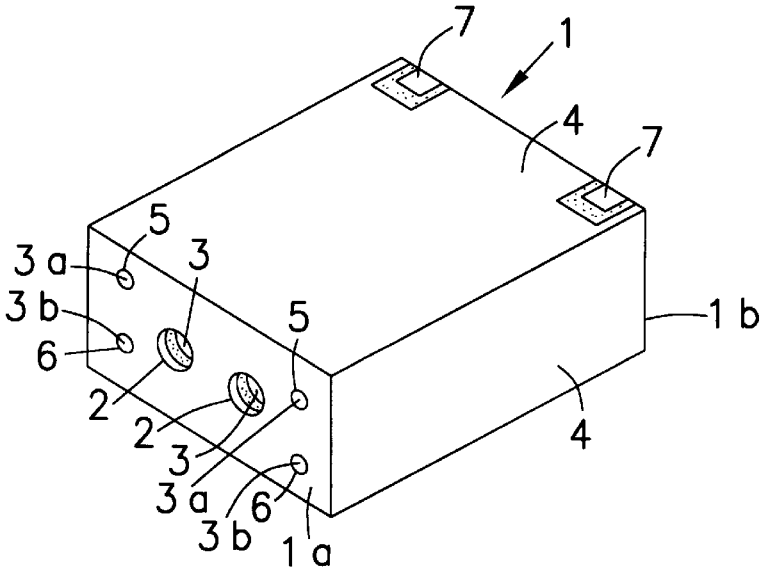
FIG. 10 is a perspective view of an additional dielectric filter according to a modification of the fourth example.

In the dielectric filter shown in FIG. 10, the dielectric block 1 is provided with two resonator holes 2. Excitation holes 5 and external coupling-adjusting holes 6 are formed outside their respective resonator holes 2. Also in this dielectric filter, the degree of external coupling can be varied by varying the position, shape, or inside diameter of each external coupling-adjusting hole. Furthermore, the external coupling and phase can be adjusted by grinding parts of conductors formed inside the excitation holes and inside the external coupling-adjusting holes. Also, the number of resonator holes formed in the dielectric block can be unity.

In the above examples, every excitation hole has at least one corresponding external coupling-adjusting hole or holes. The invention is not limited to this structure. Each external coupling-adjusting hole may be formed corresponding to more than one excitation hole.

Figure 11:
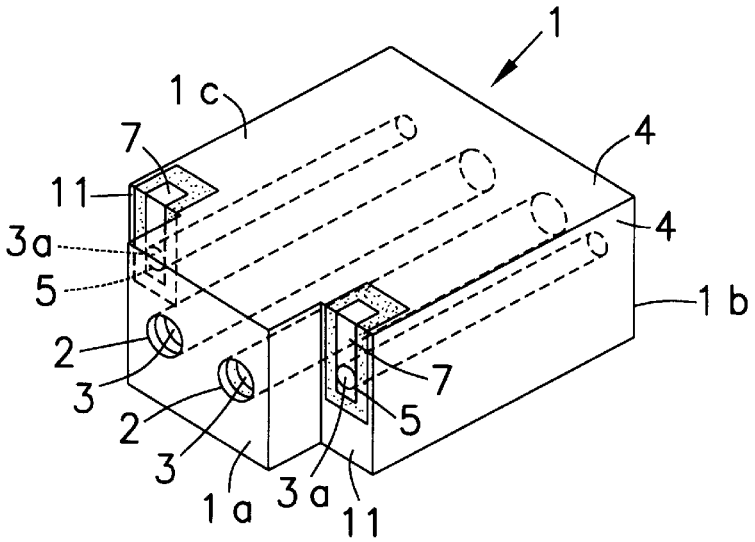
FIG. 11 is a perspective view of a dielectric filter according to a fifth example of the invention.

The structure of a dielectric filter according to a fifth example of the invention is shown in FIG. 11. As shown in FIG. 11, this dielectric filter comprises a dielectric block 1 having an open end surface 1*a* and one side surface 1*c*. This block has recessed portions 11 in which excitation holes 5 are formed on the side of the open end surface 1*a*. Thus, the open end surface 1*a* has a stepped shape. Each input/output electrode 7 extends from the corresponding recessed surface 11 to the side surface 1*c*. The excitation holes 5 extend from the recessed surfaces 11. The electrodes 7 are electrically connected with conductors 3*a* formed inside the excitation holes 5, respectively, and not connected to an outer conductor 4. This dielectric filter is similar in structure to the dielectric filter already described in connection with FIG. 1 except for these points and so those components which have been already described are not described here.

In this structure, the degree of coupling due to the electromagnetic coupling of each excitation hole 5 to the adjacent resonator hole 2 can be adjusted and set by varying the length of the excitation hole 5. That is, the degree of external coupling can be changed by varying the length of the excitation holes 5, as well as the diameter of the holes 5 and the positions of the holes 5. Hence, the external coupling can be adjusted and set with greater degree of freedom. As a result, more appropriate external coupling can be derived.

In this example, steps are formed on the side of the open side surface la. The invention is not restricted to this structure. The steps may also be formed on the side of the shorted end surface 1*b*. Furthermore, steps may be formed on both end surfaces 1*a* and 1*b*. The other examples above of a dielectric filter or antenna filter may also be modified to have these recessed surfaces 11.

Figure 12:
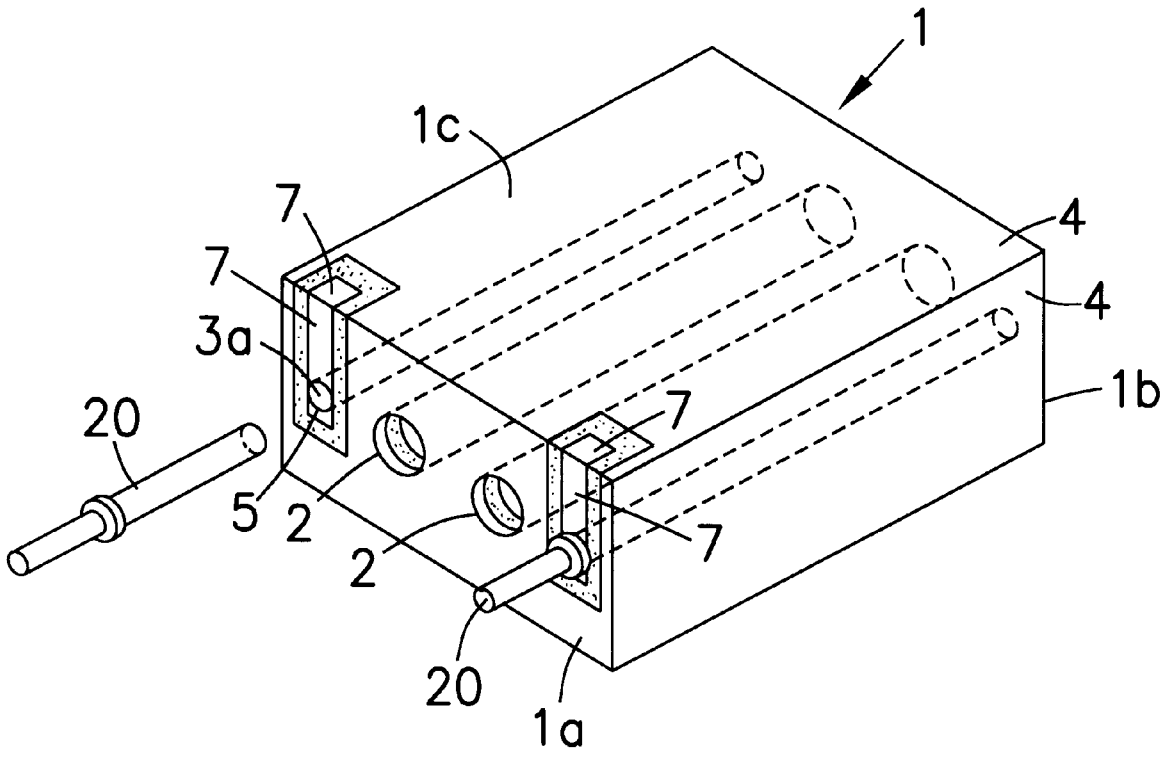
FIG. 12 is a perspective view of a dielectric filter according to a sixth example of the invention.

The structure of a dielectric filter according to a sixth example of the invention is shown in FIG. 12. As shown in FIG. 12, this dielectric filter has an open end surface 1*a* on which input/output electrodes 7 are formed. The filter is provided with excitation holes 5, and conductors 3*a* are formed inside the holes 5, respectively Input/output terminals 20 which are electrically connected with the conductors 3*a* inside the holes 5 are brought out from the open end surface 1*a*. Each input/output terminal 20 is a rod-like member made of a metal. These terminals 20 are inserted into the excitation holes 5, respectively, and soldered to the conductors 3*a*, respectively, inside the excitation holes 5 or to the input/output electrodes 7, respectively, when the terminals 20 are mounted. This dielectric filter is similar in structure to the dielectric filter previously described in conjunction with FIG. 1 except for these points. That is, this dielectric filter is similar to the dielectric filter shown in FIG. 1 except that the input/output terminals 20 are connected.

Where connection with an external circuit is made through the input/output terminals 20 as in this example, it is not always necessary to form the input/output electrodes 7. Where the input/output electrodes 7 are not formed, those portions of the outer conductor 4 which are on the end surface located on the side of the input/output terminals 20 or those portions of the conductors 3*a* inside the excitation holes 5 which are close to the end surface are partially removed to disconnect the input/output terminals 20 from the outer conductor 4.

This structure can be mounted on a mounting substrate of the terminal insertion type. The dielectric filter can be placed either horizontally or vertically by bending the input/output terminals 20. Furthermore, the locations at which the filter is connected with the packaging substrate can be set at will by varying the length of the input/output terminals 20.

Additionally, the input/output electrodes 7 can be made smaller. Alternatively, the characteristics such as Qo can be improved further without the need to form the input/output electrodes 7.

In the above examples, in addition to the example of FIG. 12, input/output terminals 20 like those shown in FIG. 12 can be inserted into the excitation holes 5, respectively, from the end surface on which the input/output electrodes 7 are formed, and then the terminals 20 are connected. Moreover, restrictions are imposed neither on the shape of the input/output terminals 20 nor on the manner in which the terminals 20 are connected with the conductors 3 inside the excitation holes 5 For instance, each input/output terminal can be fabricated by rolling a sheet metal plate into a tube and pressing it against the conductors 3*a* inside the excitation holes 5 for connection.

The structure of a dielectric filter according to a seventh example of the invention is shown in FIG. 13. As shown in FIG. 13, this dielectric filter has an open end surface la into which input/output terminals 20 are inserted. A metallic casing 30 is mounted on the dielectric block 1 so as to cover the open end surface 1*a*. The metallic casing 30 is soldered to the outer conductor 4, thus constructing the dielectric filter. Parts of the metallic casing 30 have apertures to permit the input/output terminals 20 to be brought out and to prevent the casing 30 from touching the input/output electrodes 7. This dielectric filter is similar in structure to the filter shown in FIG. 12 except for these points. That is, this example of dielectric filter is similar to the sixth example of dielectric filter shown in FIG. 12 except that the metallic casing 30 is mounted on it. A substrate may be inserted between the open end surface 1*a* and the metallic casing 30.

When this dielectric filter is mounted on a packaging substrate (not shown), input/output terminals 20 and protruding portions 30*a* of the metallic casing 30 are inserted into the packaging substrate. In this structure, the open end surface 1*a* is covered with the metallic casing 30 and so leakage of electro-magnetic field through the opening of each resonator hole 2 can be reduced. This metallic casing 30 can also be mounted to other examples of dielectric filter.

In the above examples described thus far, coupling between adjacent resonators is provided by stray capacitance created in nonconductive portions in the inner conductors. The invention is not limited to this structure. Coupling holes or other coupling means may also be used to couple together the adjacent resonators. Furthermore, the manner in which the conductors inside the resonator holes are disconnected from the outer conductor at the open end surface is not limited to the method of the illustrated examples.

As described thus far, in a dielectric filter according to the present invention, the input/output portions are provided with excitation holes. External coupling is provided by electromagnetic coupling of each excitation hole to the adjacent resonator hole. The best external coupling can be obtained by appropriately establishing the inside diameter, positions, or the length of the excitation holes so as to adjust or establish the degree of external coupling. Furthermore, it is not necessary to make the resonator holes in eccentric positions in order to adjust the external coupling. Hence, the Qo is prevented from decreasing In another dielectric filter according to the invention, external coupling-adjusting holes are formed close to external coupling excitation holes. Desired external coupling and phase can be obtained by appropriately establishing the positions, shape, and dimensions of the external coupling-adjusting holes. In consequence, the external coupling and phase can be established with greater degree of freedom. The external coupling can be weakened by forming the external coupling-adjusting holes. Therefore, the distance between each excitation hole and the adjacent resonator hole can be reduced. This enables miniaturization of the filter. Furthermore, the coupling between two resonator holes which are adjacent to each other via an excitation hole can be suppressed by the external coupling-adjusting holes. Therefore, even where a plurality of filters are formed in one dielectric block, interference between the filters can be prevented. The characteristics of the filters can be adjusted easily. Hence, good characteristics can be obtained. After a filter has been constructed, external coupling and phase can be adjusted by grinding parts of conductors or dielectric substances inside excitation holes. Therefore, the characteristics can be improved. Also, the defective percentage can be reduced greatly. Hence, the fabrication cost can be reduced. Moreover, the input/output electrodes can be made smaller than previously. The resonator length can be shortened without deteriorating Qo.

If the filter is connected with an external circuit by the use of input/output terminals, it is not necessary to form input/output electrodes. Furthermore, Qo is prevented from droppings The filter can be mounted on a mounting substrate of the terminal insertion types In addition, leakage of electromagnetic field can be reduced by mounting a metallic casing.

Thus, according to the present invention, a small-sized dielectric filter which can be easily mounted on a substrate can be variously mounted, has high Qo, and has optimum external coupling and phase can be obtained.

Although several preferred embodiments and features of the invention have been disclosed herein, the claimed invention is not limited to those embodiments, but rather should be considered to include all modifications, variations and equivalents thereto that may occur to those having the ordinary level of skill in the pertinent art.

What is claimed is:

1. A dielectric filter comprising:

a dielectric block having two opposite end surfaces and an outer surface extending therebetween;

a plurality of resonator holes in said dielectric block extending between said end surfaces;

inner conductors on surfaces of said resonator holes;

an outer conductor on said outer surface and said end surfaces of said dielectric block, and connected to said inner conductors at both of said end surfaces;

each of said inner conductors in said resonator holes having a respective non-conductive gap therein which separates the corresponding said inner conductor into two portions, each of said portions being connected to said outer conductor at a corresponding one of said end surfaces;

one of said end surfaces being a short-circuited end surface, said non-conductive gaps in said resonator holes being farther from said short-circuited end surface than from the other said end surface;

excitation holes in said dielectric block adjacent to corresponding ones of said resonator holes;

said excitation holes having respective inner conductors which are connected to said outer conductor at said other end surface of said dielectric block; and input/output electrodes on said short-circuited end surface of said dielectric block, each said input/output electrode being electrically connected with a respective one of said inner conductors in said excitation holes, and not being connected to said outer conductor;

said excitation holes being electromagnetically coupled to said corresponding ones of said resonator holes, thereby providing external coupling between said corresponding ones of said resonator holes and said respective input/output electrodes.

2. A dielectric filter comprising:

a dielectric block having two opposite end surfaces and an outer surface extending therebetween;

a plurality of resonator holes in said dielectric block extending between said end surfaces;

inner conductors on surfaces of said resonator holes;

an outer conductor on said outer surface and said end surfaces of said dielectric block, and connected to said inner conductors at both of said end surfaces;

each of said inner conductors in said resonator holes having a respective non-conductive gap therein which separates the corresponding said inner conductor into two portions, each of said portions being connected to said outer conductor at a corresponding one of said end surfaces;

one of said end surfaces being a short-circuited end surface, said non-conductive gaps in said resonator holes being farther from said short-circuited end surface than from the other said end surface;

excitation holes in said dielectric block adjacent to corresponding ones of said resonator holes;

said excitation holes having respective inner conductors which are connected to said outer conductor at said other end surface of said dielectric block; and input/output electrodes on said short-circuited end surface of said dielectric block, each said input/output electrode being electrically connected with a respective one of said inner conductors in said excitation holes, and not being connected to said outer conductor;

wherein each of said excitation holes has a predetermined position, shape, and size so as to obtain a corresponding predetermined external coupling and phase between said corresponding ones of said resonator holes and said respective input/output electrodes.

3. A dielectric filter comprising:

a dielectric block having two opposite end surfaces and an outer surface extending therebetween;

a plurality of resonator holes in said dielectric block extending between said end surfaces;

inner conductors on surfaces of said resonator holes;

an outer conductor on said outer surface and said end surfaces of said dielectric block, and connected to said inner conductors at both of said end surfaces;

each of said inner conductors in said resonator holes having a respective non-conductive gap therein which separates the corresponding said inner conductor into two portions, each of said portions being connected to said outer conductor at a corresponding one of said end surfaces;

one of said end surfaces being a short-circuited end surface, said non-conductive gaps in said resonator holes being farther from said short-circuited end surface than from the other said end surface;

excitation holes in said dielectric block adjacent to corresponding ones of said resonator holes;

said excitation holes having respective inner conductors which are connected to said outer conductor at said other end surface of said dielectric block;

input/output electrodes on said short-circuited end surface of said dielectric block, each said input/output electrode being electrically connected with a respective one of said inner conductors in said excitation holes, and not being connected to said outer conductor;

external coupling-adjusting holes in said dielectric block close to corresponding ones of said excitation holes, respectively, for adjusting external coupling between said corresponding ones of said resonator holes and said respective input/output electrodes; and inner conductors on surfaces of said external coupling-adjusting holes.

4. A dielectric filter of any one of claims 1–3, wherein each of said input/output electrodes extends from said short-circuited end surface to said outer surface of said dielectric block.

5. A method of providing predetermined external coupling and phase in a dielectric filter, comprising the steps of:

(a) providing a dielectric filter which includes:

a dielectric block having two opposite end surfaces and an outer surface extending therebetween;

a plurality of resonator holes formed in said dielectric block between said end surfaces;

inner conductors formed on surfaces of said resonator holes;

an outer conductor formed on said outer surface and said end surfaces of said dielectric block, said outer conductor being connected to said inner conductors at both of said end surfaces;

each of said inner conductors in said resonator holes having a respective non-conductive gap therein which separates the corresponding said inner conductor into two portions, each of said portions being connected to said outer conductor at a corresponding one of said end surfaces;

one of said end surfaces being a short-circuited end surface, said non-conductive gaps in said resonator holes being farther from said short-circuited end surface than from the other said end surface;

excitation holes formed in said dielectric block adjacent to corresponding ones of said resonator holes; and said excitation holes having respective inner conductors which are connected to said outer conductor at said other end surface of said dielectric block;

(b) providing input/output electrodes on said short-circuited end surface of said dielectric block, each said input/output electrode being electrically connected with a respective one of said inner conductors in said excitation holes, and not being connected to said outer conductor; and (c) adjusting at least one of the positions, shapes, and sizes of said excitation holes so as to obtain predetermined external coupling and phase between said corresponding ones of said resonator holes and said respective input/output electrodes.

6. A method as recited in claim 5, wherein said adjusting step comprises the step of providing respective said excitation holes with corresponding predetermined diameters.

7. A method as recited in claim 5, wherein said adjusting step comprises the steps of arranging said resonator holes so as to define a common center plane, and offsetting a respective one of said excitation holes by a corresponding predetermined distance from said common center plane defined by said resonator holes.

8. A method as recited in claim 5, wherein said adjusting step comprises the step of spacing respective said excitation holes by a corresponding predetermined distance from said resonator holes.

9. A method as recited in claim 5, wherein said adjusting step comprises the steps of arranging said resonator holes so as to define a common center plane, and forming a respective one of said excitation holes with a corresponding elongated cross-sectional shape having a longitudinal axis and orienting said longitudinal axis substantially perpendicular to said common center plane defined by said resonator holes.

10. A method as recited in claim 5, wherein said adjusting step comprises the steps of arranging said resonator holes so as to define a common center plane, and forming a respective one of said excitation holes with a corresponding elongated cross-sectional shape having a longitudinal axis and orienting said longitudinal axis substantially parallel to said common center plane defined by said resonator holes.

11. A method as recited in claim 10, wherein said respective excitation holes are substantially centered on said common center plane.

12. A dielectric filter as claimed in claim 3, wherein said inner conductors inside said external coupling adjusting holes are connected to said outer conductor at both of said end surfaces of said dielectric block.

13. A dielectric filter as claimed in claim 1, wherein said plurality of resonator holes comprises first and second resonator holes and said excitation holes comprise corresponding first and second excitation holes.

14. A dielectric filter as claimed in claim 13, wherein said first and second resonator holes are disposed between said first and second excitation holes.

15. A dielectric filter as claimed in claim 2, wherein said plurality of resonator holes comprises first and second resonator holes and said excitation holes comprise corresponding first and second excitation holes.

16. A dielectric filter as claimed in claim 15, wherein said first and second resonator holes are disposed between said first and second excitation holes.

17. A dielectric filter as claimed in claim 3, wherein said plurality of resonator holes comprises first and second resonator holes and said excitation holes comprise corresponding first and second excitation holes.

18. A dielectric filter as claimed in claim 17, wherein said first and second resonator holes are disposed between said first and second excitation holes.

19. A dielectric filter as claimed in claim 18, wherein said external coupling-adjusting holes comprise first and second coupling-adjusting holes which correspond respectively to said first and second excitation holes.

20. A dielectric filter as claimed in claim 19, wherein said first and second resonator holes are disposed between said first and second coupling-adjusting holes.

21. A method as claimed in claim 5, wherein said plurality of resonator holes comprises first and second resonator holes and said excitation holes comprise corresponding first and second excitation holes.

22. A method as claimed in claim 21, wherein said first and second resonator holes are disposed between said first and second excitation holes.

23. A dielectric antenna duplexer comprising:

a dielectric block having first and second opposite end surfaces and an outer surface extending therebetween;

a plurality of resonator holes in said dielectric block extending between said end surfaces, and inner conductors on surfaces of said resonator holes;

an outer conductor on said outer surface and said end surfaces of said dielectric block, said outer conductor being connected to said inner conductors at both of said end surfaces;

each of said inner conductors in said resonator holes having a respective non-conductive gap therein which separates the corresponding inner conductor into two portions, each of said portions being connected to said outer conductor at a corresponding one of said end surfaces;

said first end surface being a short-circuited end surface, said non-conductive gaps in said resonator holes being disposed farther from said first end surface than from the second end surface;

excitation holes in said dielectric block adjacent to and electromagnetically coupled with corresponding ones of said resonator holes, said excitation holes having respective inner conductors which are connected to said outer conductor at said second end surface of said dielectric block; and input/output electrodes on said short-circuited end surface of said dielectric block, each said input/output electrode being electrically connected with a respective one of said inner conductors in said excitation holes, and not being connected to said outer conductor;

wherein said electromagnetic coupling between said excitation electrodes and said resonator holes provides external coupling between said resonator holes and said corresponding input/output electrodes;

said input/output electrodes comprising first, second and third input/output electrodes, said first, second and third input/output electrodes and said corresponding excitation holes being arranged among said resonator holes to define a first group of resonator holes which provides a transmission filter and a second group of resonator holes which provides a reception filter;

said first input/output electrode being coupled to a respective resonator hole in said first group of resonator holes to provide a transmission input terminal;

said second input/output electrode being coupled to a respective resonator hole in said second group of resonator holes to provide a reception output terminal; and said third input/output electrode being coupled in common to a respective resonator hole in each of said first and second groups of resonator holes to provide an antenna input/output terminal.

24. A dielectric duplexer as claimed in claim 23, further comprising an additional resonator hole which is adjacent to and coupled with one of said first and second input/output electrodes so as to provide a trap filter for trapping a frequency in a signal at said one of said first and second input/output electrodes.

25. A dielectric duplexer as claimed in claim 24, wherein said one of said first and second input/output electrodes is disposed between said trap filter and the respective transmission or reception filter which corresponds to said one of said first and second input/output electrodes.

26. A dielectric duplexer as claimed in claim 24, further comprising external coupling-adjusting holes in said dielectric block close to corresponding ones of said excitation holes, respectively, and inner conductors on surfaces of said external coupling-adjusting holes, for adjusting external coupling between said corresponding ones of said resonator holes and said respective input/output electrodes.

27. A dielectric duplexer as claimed in claim 26, wherein one of said coupling-adjusting holes is disposed between said trap filter and the respective transmission or reception filter which corresponds to said one of said first and second input/output electrodes.

28. A dielectric duplexer as claimed in claim 26, wherein said inner conductors inside said coupling adjusting holes are connected to said outer conductor at both of said end surfaces of said dielectric block.

* * * * *